United States Patent [19]

Movshovitz et al.

[11] Patent Number: 4,517,808

[45] Date of Patent: May 21, 1985

[54] HEAT PUMPING SYSTEM

[75] Inventors: Avner Movshovitz, Tel Aviv; Amos Ityel, Ramat Aviv, both of Israel

[73] Assignee: Amcor Ltd., Tel Aviv, Israel

[21] Appl. No.: 594,830

[22] Filed: Mar. 29, 1984

[30] Foreign Application Priority Data

Sep. 5, 1983 [IL] Israel ..... 69662

[51] Int. Cl.[3] ..... F25B 13/00

[52] U.S. Cl. ..... 62/160; 62/185; 62/324.6

[58] Field of Search ..... 62/160, 238.7, 324.6, 62/324.1, 185

[56] References Cited

U.S. PATENT DOCUMENTS 4,380,156 4/1983 Ecker ..... 62/324.6

*Primary Examiner*—William E. Wayner

*Attorney, Agent, or Firm*—Browdy and Neimark

[57] ABSTRACT

A heat transfer system is disclosed in which heat is transferrable to a first primary user by means of a two-coil heat exchanger acting as a condenser which is in the high pressure path, while at the same time another two-coil heat exchanger used as a condenser is used to provide cooling to a record primary user. The system also includes a fan type heat exchanger, which acts as the condenser, when the first primary user does not need heating energy. The system is also operable to heat the second primary user whose heat exchanger acts as a condenser, connectible in series with the heat exchanger of the first primary user.

7 Claims, 4 Drawing Figures

Fig. 2
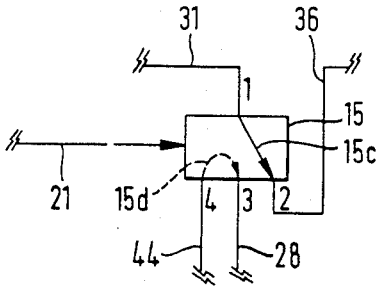
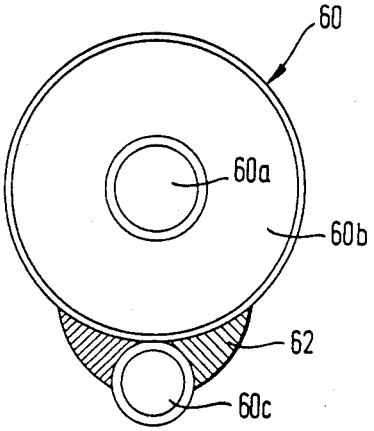
Fig. 3

HEAT PUMPING SYSTEM

The present invention generally relates to a heat pumping system and, more particularly, to a system of separately and/or simultaneously cooling and/or heating separate bodies of fluid more simply and efficiently, than herebefore attainable.

There are many well known systems in which bodies of matter, such as water or air, both of which can be thought of as fluids, are cooled or heated. The typical refrigerator is one example of a system purposely designed to cool the air inside the refrigerator by means of transfer of heat to the external air. Thus, it is an air-to-air cooling system. The typical home air conditioner is also an air-to-air cooling system. It can be operated to cool the air inside the house, just like in a refrigerator, in which the transfer of heat occurs from the enclosed air being cooled to the refrigerant, e.g. freone. The typical air conditioner can also serve to heat the house. In this case heat is transferred from the high temperature refrigerant to the air in the house.

There are quite a number of situations in which it is desirable to cool and/or heat different bodies of fluid in as efficient a manner as possible and with a system which is not complex to minimize cost as well as maintenance problems. It is toward such a system that the present invention is directed. Briefly, the system of the present invention comprises:

First, second and third controllable heat exchanger means, each having a primary coil through which refrigerant is adapted to flow, with said first and second exchanger means further including at least a second coil in heat transfer contact with said primary coil for providing a separate path for fluid to flow therein and said third exchanger means includes operable means for circulating fluid about the primary coil of the third heat exchanger;

compressor means having an inlet and an outlet for compressing gaseous refrigerant supplied thereto at its inlet and for providing compressed gaseous refrigerant at the outlet thereof;

a two state flow path reversing valve having first, second, third and fourth ports, said valve providing two separate flow paths between its first and fourth ports and its second and third ports, when being in a first of its two states, and further providing two separate flow paths between its first and second ports and its third and fourth ports, when being in its second state;

expansion valve means for expanding liquid refrigerant, supplied thereto to effectively reduce its pressure;

first means for providing a refrigerant flow path between said third port and the compressor's inlet, and between the compressor's outlet and the first port of said valve, through the primary coil of said first heat exchanger;

second means for providing refrigerant flow path between said second and fourth ports through the primary coil of said second heat exchanger, said expansion valve means and the primary coil of said third heat exchanger connected thereby in series; and control means including manually controllable switches for controlling said system, whereby when said valve is in said first state either said first heat exchanger or said third heat exchanger is operable as a condenser whereby heat is transferred away from the refrigerant in the primary coil of the first heat exchanger, serving as a condenser, and said second heat exchanger is operable as an evaporator for receiving heat for the refrigerant in its primary coil, and when said valve is in its second state either or both of said first and second heat exchangers are operable as serially connected condensers and said third heat exchanger is operable as an evaporator.

As will become apparent from the following description the novel system, which can be thought of as a heat pumping system, is one which is capable of providing cooling and/or heating to separate primary as well as secondary users, based on requirements of the primary users and preselected priorities between them. For example, it can cool or heat one primary user, hereafter referred to as user A, by means of the second heat exchanger while heating another primary user B, by means of the first heat exchanger. It can also heat both users simultaneously, under varying priorities, as will be explained hereafter. In addition it can provide cooling to one secondary user C, when primary user A is cooled as well as heat another secondary user D, when primary user B is heated. All of the above is achievable by the system, which is relatively free of complex valving arrangements.

The novel features of the invention are set forth with particularity in the appended claims. The invention will best be understood from the following description when read in conjunction with the accompanying drawings.

FIGS. 1 and 2 are combination block and schematic diagrams of the novel system, with its reverse valve, shown in its two different states;

FIG. 3 is a simple cross-sectional view of a heat exchanger with a primary coil and two secondary coils.

Figure 1:
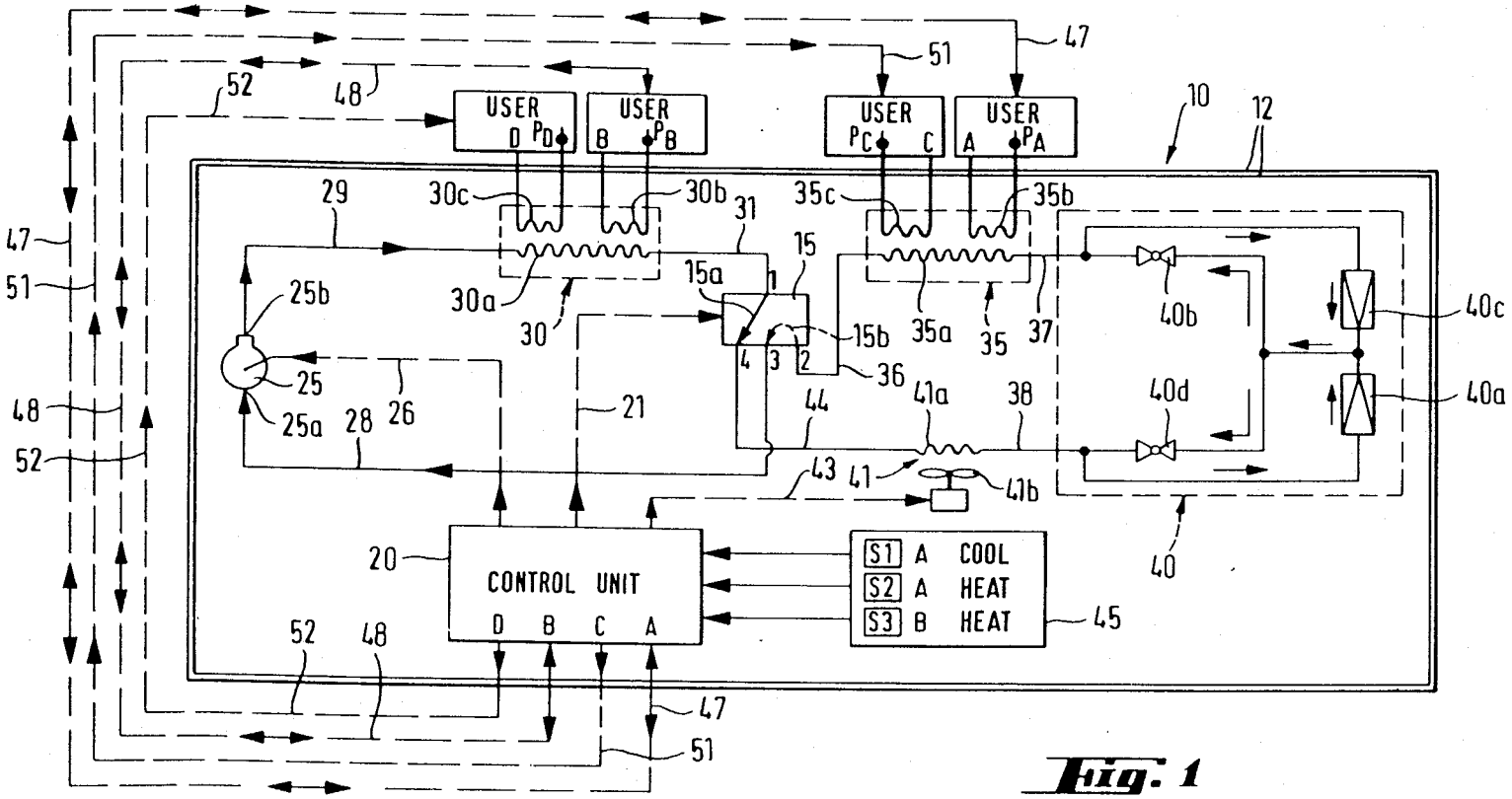

Attention is now directed to FIGS. 1 and 2 in connection with which the novel heat transfer pumping system, hereafter referred to as the pumping system or simply the system, will be described. In these Figures the system is designated by 10. Its boundaries are represented by double lines 12. For explanatory purposes the system is assumed to service two primary users A and B and two secondary users C and D, designated by blocks. In order not to encumber the description the secondary users will first be ignored.

The pumping system includes a two position reverse flow control valve 15, hereafter simply referred to as the reverse valve, or simply the valve. As shown, it includes four ports, designated by the numerals 1, 2, 3 and 4. In FIG. 1 the reverse valve 15 is shown in one of its two states in which it provides two flow paths, one between ports 1 and 4 as represented by 15*a*, and one between ports 2 and 3, designated by 15*b*. In FIG. 2 the valve is shown in its other state in which it also provides two flow paths—one between ports 1 and 2, designated by 15*c* and one between ports 3 and 4, represented by 15*d*. It is control unit 20 which controls the state of the valve, as well as other parts of the system, as will be described. The control line from unit 20 to the valve is designated by dashed line 21.

Viewing the left hand side of FIG. 1 it is seen that a compressor 25, controlled by unit 20 via control line 26 is included. Its input 25*a* is connected to port 3 of valve 15 by a conduit or pipe 28, through which refrigerant is assumed to flow to the compressor 25. The refrigerant, which regardless of the state of valve 15, is in gaseous state and at low temperature, is compressed by the compressor and is fed out of the compressor's output 25*b* to a pipe 29, which is connected to one end of the primary coil 30*a* of a controllable heat exchanger 30. The other end of the coil 30*a* is connected to port 1 of valve 15 by a pipe section 31. Ignoring user D, the heat exchanger 30 includes a secondary coil 30*b* which is connected via pipes (not designated) to user B. Whether or not fluid flows in coil 30*b* and thus heat is exchanged, depends on whether a circulating pump of user B, designated $P_B$, is On or Off, which in turn depends on various conditions to be described hereafter.

As seen on the right side port 2 of valve 15 is connected to one end of a primary coil 35*a* of a controllable heat exchanger 35 by means of a pipe 36. Pipes 37 and 38 connect a valve expansion assembly 40 to the other end of coil 35*a* and to a coil 41*a* of a heat exchanger 41. The latter includes a fan 41*b*, which is under the control of unit 20, via a control line 43. When the fan operates, it circulates air around coil 41*a*, to exchange heat with the refrigerant therein. Pipe 44 connects coil 41*a* to port 4. Ignoring user C, the secondary winding 35*b* of heat exchanger 35 is connected to user A. As in the case of user B, fluid flows in coil 35*b*, depending on whether the circulating pump of user A, designated $P_A$, operates or not.

For explanatory purposes it is assumed that user B can only request to receive heat to heat a body of fluid, e.g. water in a swimming pool. As to user A, it can request to be heated or cooled by the system. To this end the system is assumed to include a control panel 45 which is connected to the control unit 20 to provide it with an indication of the state of each one of 3 On-Off switches, designated S1, S2 and S3. Switch S1 is turned On when user A is to be cooled, while to heat user A switch S2 is turned On. To heat user B switch S3 is turned On. Clearly, with 3 two-position switches there are $2^3=8$ possible combinations. When all 3 switches are Off, the compressor is deactivated and the pumping system does not operate. However, when at least one of these 3 switches is On, it indicates that a demand is made by one of the primary users A and/or B. As long as the demand (or demands) is (or are) not totally satisfied the compressor keeps operating.

The novel system may best be described in connection with several specific examples of different requests. If only user A is to be cooled, e.g. user A being assumed to be a house, switch S1 is turned On. As a result the control unit 20 activates the compressor 25, and switches valve 15 to the position shown in FIG. 1 and turns on the fan 41*b*. Also the control unit 20, by means of 2-way control lines 46 activates pump $P_A$ of user A. In such an arrangement the system 10 operates in a cooling mode of a cooling-heating air conditioning system. That is, gaseous refrigerant at high pressure and temperature, e.g. 50° C. passes via pipe 29, coil 30*a*, pipe 31, ports 1 and 4 of valve 15, and pipe 44 to heat exchanger 41. Due to the fan 41*b*, circulating colder air around coil 41*a*, in which hot refrigerant gas flows, the gas condenses to a liquid. That is, the heat exchanger 41 acts as a condenser.

The liquid at high pressure passes via pipe 38 to valve expansion unit 40 with two one direction flow control valves 40*a* and 40*b* and two expansion valves 40*b* and 40*d*. Due to the interconnections in unit 40, the high pressure refrigerant passes through valve 40*a* to expansion valve 40*b*. Therein it expands, as is known, and thus its pressure drops as well as its temperature. As it passes heat exchanger 35 it absorbs heat from the fluid in coil 35*b*, thus cooling user A. The absorbed heat causes the refrigerant to evaporate. Thus heat exchange 35 acts as the evaporator. Therefrom, and via 36 ports 2 and 3 of valve 15 and pipe 28, the gaseous cold refrigerant is fed again to the compressor 25.

It should be stressed that in a conventional cooling system as just described, heat exchanger 41 acts as a condenser. The condensation energy is released by the high temperature refrigerant which is being condensed, and is absorbed by the external air which heats up. However, no use is made of the delivered energy to the external heat which blows away uselessly. Thus, energy is wasted. Unlike the prior art, in the present invention, heat exchanger 30 is placed between the high pressure side of the compressor and the reverse valve 15. The gaseous refrigerant entering coil 30*a* is at a high temperature. Use can be made thereof, as will be described and thus greatly increase the system's efficiency.

Considering the example, just described, in which user A is cooled, it is desired to also heat the water of user B. To this end switch S3 is also turned On. Upon turning it On, unit 20 activates pump $P_B$ of user B and turns Off the fan 41*b*. The resulting effect is that heat exchanger 30 replaces exchanger 41 and the system's condenser. Therein colder water in coil 30*b* condenses the gaseous refrigerant in coil 30*a*, thereby absorbing heat therefrom. Thus, the water which returns to user B is hotter, as a result of the absorbed energy. Thus, the heat of condensation is not wasted as is the case when exchanger 41 is used as a condenser. Rather, use is made thereof to heat the water of user B, while cooling user A.

It should be pointed out that heat exchanger 30, since it may replace heat exchanger 41 to operate as a condenser, is designed to be sufficiently large to perform as the system's condenser. It should also be pointed out that to cool user A, heat exchanger 35 acts as an evaporator and thus has to be sufficiently large for the system. As to user A it is assumed to include temperature sensors, thermostats, and the like, to set the desired temperature and to sense it when it is reached. When the desired temperature is reached the pump $P_A$ of user A may be turned Off by these devices directly and send a signal, indicating such turn-off to unit 20. On the other hand, if desired, signals, indicating when a desired temperature has been reached, may be sent to control unit 20 via two-way signal lines 47. Unit 20 would then send a signal to turn off pumm $P_A$. Similar conditions exist with regard to user B. It is connected to unit 20 via two-way signal lines 48.

In the particular example, when both switches S1 and S3 are pressed indicating that the house of user A is to be cooled and the water of user B is to be heated, it was explained that heat exchangers 35 and 30 operate as an evaporator and condenser, respectively. Heat exchanger 41 is inoperative in that its fan 41*a* is Off. Assuming that the water of user B was heated sufficiently, exchanger 30 stops operating as a condenser, since water no longer flows in coil 30*b*. Under these conditions the control unit 20 turns On fan 41*b* so that exchanger 41 now becomes the system's operative condenser. On the other hand, if user A has been cooled sufficiently and its pump $P_A$ was turned off, exchanger 35 no longer operates as an evaporator. Under these conditions the reverse valve is switched to the position or state shown in FIG. 2, and fan 41*b* is turned On. In this state of valve 15, ports 1 and 2 are interconnected. Thus, the condensed high temperature refrigerant from exchanger 30 flows via the valve 15, pipe 36, inactive exchanger 35 and pipe 37 to expansion valve unit 40. Therein it flows through direction flow control valve 40*c* to the expansion valve 40*d*. Therefrom it flows via pipe 38 to coil 41*a* of exchanger 41, which now acts as an evaporator. The evaporated or gaseous refrigerant then flows via pipe 44, ports 3 and 4 of valve 15 and pipe 28 to the compressor 25. Clearly, when both users A and B have been sufficiently cooled and heated respectively, i.e. no more heat has to be transferred, the pumping system is turned Off by the control unit 20.

As previously pointed out, user A may require heating rather than cooling, which is indicated by the setting of switch S2 to its On state. When so set, the control unit 20 switches the reverse valve 15 to its state in FIG. 2 and activates fan 41*b*. As long as user A is to be heated, exchanger 41 operates as an evaporator, since exchanger 35 now operates as a condenser. If, while switch S2 is On, i.e. user A is to be heated and switch S3 is Off, i.e. user B is not to be heated, exchanger 30 is inoperative even though it is in the refrigerant flow loop. Under these conditions, the system 10 operates as one user (A) heating system.

In accordance with the present invention, user B may be heated, by turning switch S3 On, while at the same time user A is to be heated. Under such conditions, both exchangers 30 and 35 are operative as serially connected condensers by means of the flow path provided by the valve 15 through its interconnected ports 1 and 2, as shown in FIG. 2. Which of the two users A and B is heated can depend on an order of priorities chosen by the system operator by means of control unit 20. The latter can control the pumps of users A and B, so that user B is supplied with heat, only after user A has been heated to the desired temperature or vice versa. In these two possibilities at any given time only one of the heat exchangers 30 and 35 acts as the condenser, while the other is inoperative. If desired, however, based on less than 100% priority for either user A or B, a priority criterion can be set so that both exchangers 30 and 35 will operate as condensers, by pumps $P_B$ and $P_A$ being turned On simultaneously and thus heat both users B and A simultaneously, albeit at less than a maximum rate for each. This may be achieved by controlling the flow rates of the fluids in coils 30*b* and 35*b* of the two heat exchangers, 30 and 35.

As will be described hereafter in more detail, in some situations it may be desired to both heat and cool user A simultaneously. Let it be assumed that user A is a home in the winter. In a given case it may be desired to cool a part of the home, e.g. the living room in which a party is being held while heating another portion of the home, e.g. the bedrooms in which children may be present. As will be described, this may be achieved by switching both switches S1 and S2 On at the same time. With a minimum of additional controls heat exchanger 35 may be controlled to operate cyclically, based on selected criteria to cool and heat separate bodies of fluid which are in turn used in user A to heat and cool different ones of its parts. Furthermore, while switches S1 and S2 are On, switch S3 may be turned On to heat user B at the same time. These aspects of the invention will be described hereafter, only after describing either the cooling or heating of user A with or without heating user B.

From the foregoing it should thus be apparent that with the system of the present invention one can accomplish any of the following:

(a) cool user A only
(b) heat user A only
(c) heat user B only
(d) cool user A and heat user B, continuously
(e) heat user A and heat user B, based on variable priority criteria
(f) cool part of user A while heating another part of user A
(g) cool part of User A while heating another part of user A and heat user B.

Any one of these modes of operation is determined by the states of only the three manually settable two-state switches S1, S2 and S3 on the control panel 45 and by the signals sent by unit 20 to either or both users A and B and by the feedback signals from either or both of these two users. Although the novel system operates most efficiently when user A is cooled while at the same time user B is heated as previously explained, the novel system provides significant advantages even when operating in any of the other modes. It is apparent from the Figures and the foregoing description that except for the reverse valve 15 and those in unit expansion valve unit 40, the system is totally devoid of complex valving assemblies, often used in the prior art to separate non-compatible fluids which are to be heated and/or cooled, such as chlorinated swimming-pool water with drinking water, or the like. In the system of the present invention the fluids to be heated and/or cooled, such as swimming-pool water of user B, and the air and/or water from user A flow in separate coils, such as 30*b* and 35*b*, respectively.

The system is controlled by the control unit 20 based on the states of switches S1–S3 and the feedback signals from users A and B, such as their existing and desired temperatures. Based thereon it controls valve 15, compressor 25, fan 41*b* and pumps $P_A$ and $P_B$. It is apparent that the control unit 20 may be configured in many different ways by means of switches, relays and the like, to perform the desired functions.

Attention is now directed to the previously ignored secondary users C and D. User C is assumed to be one that may desire cooling, e.g. to cool drinking water. Its total desired energy is assumed to be quite small compared with that desired by user A. Unlike users A and B which send feedback signals to the control unit 20, user C only receives indication signals from the control unit via one-way control lines 51. Only when exchanger 35 operates as an evaporator, which is the case when cooling is supplied to user A, can user C receive cooling. It includes a circulating pump $P_C$ which when turned On circulates fluid, e.g. water, through coil 35*c* which is cooled by transferring evaporation heat to the low temperature liquid refrigerant flowing through coil 35*a*. User C includes a thermostat which sets the desired water temperature. Only when user A is cooled and the temperature of the water of user C is above the desired one, is pump $P_C$ activated internally in user C, until the desired cold temperature is achieved, and the pump $P_C$ is turned Off. However, when user A is not cooled, as indicated by the signals from unit 20, the pump $P_C$ is inoperative even when the water temperature is higher than desired.

Secondary user D is similar to user C, except that user D is one which may desire heat, e.g. to heat water for household use. User D is supplied with indication signals via one-way signal lines 52. Whenever the system is operative, i.e. the compressor is On which is the case whenever at least one of the three switches S1–S3 is On, can user D receive heating energy. Only under these conditions and when the water of user D is colder than desired, is pump $P_D$ of user D turned on internally to cause colder than desired water to flow through coil 30*c*. Exchanger 30 operates as a condenser, and thus heat is transferred from the hotter, gaseous refrigerant in coil 30*a*, to the water flowing in coil 30*c*. It should be stressed that typically the amount of heat supplied to user D is only a small fraction of that which is or may be supplied to user B.

It should be apparent from the foregoing that exchanger 30, when operative, operates only as a condenser. On the other hand, exchanger 35 operates as a condenser when user A is heated, and as an evaporator when user A is cooled.

Two-coil heat exchangers are well known. Typically, such an exchanger assumes a co-axial configuration, as shown in FIG. 3, wherein the co-ax is designated by 60. The refrigerant, e.g. freone flows in the outer coil 60*b* and the fluid to be cooled, e.g. water, flows in the inner coil 60*a*. Exchanger 30 which operates only as a condenser may assume such a configuration for coils 30*a* and 30*b*, wherein coils 30*a* and 30*b* are analogous to coils 60*b* and 60*a*, respectively. In accordance with the present invention, the additional coil 30*c* is attached as coil 60*c* to outer coil 60*b*, as shown in FIG. 3. The attachment is achieved by means of matter 62, which has high heat conductive properties. Thus, heat in co-ax outer coil 60*b* is transferred efficiently to the fluid (water) in coil 60*c*. It should thus be clear that heat exchanger 30, as designated by 60 in FIG. 3, is a refrigerant-to-water and refrigerant-to water heat exchanger.

As to exchanger 35 since it sometimes has to operate as a condenser and sometimes as an evaporator it is designed to be large enough to function as an evaporator and thus be sufficiently large for condensation purposes. As viewed with respect to FIG. 3, coils 60*a*, 60*b* and 60*c* represent coils 35*a*, 35*b* and 35*c*, respectively, of exchanger 35. That is, the refrigerant flows in the inner coil 60*a* and water of users A and C flow in coils 60*b* and 60*c*, respectively. Thus heat exchanger 35 is in effect a water-to-refrigerant and water-to-water heat exchanger.

As previously pointed out, by depressing both switches S1 and S2 so that both of them are On at the same time, one can cool one part of user A such as the living room, while heating another part of the body. Clearly, a heat exchanger cannot operate simultaneously as both an evaporator and condenser. However, by means of additional controls and signals from user A and some energy storing units therein, this can be accomplished, as will be explained in connection with FIG. 4, to which reference is now made.

Figure 4:
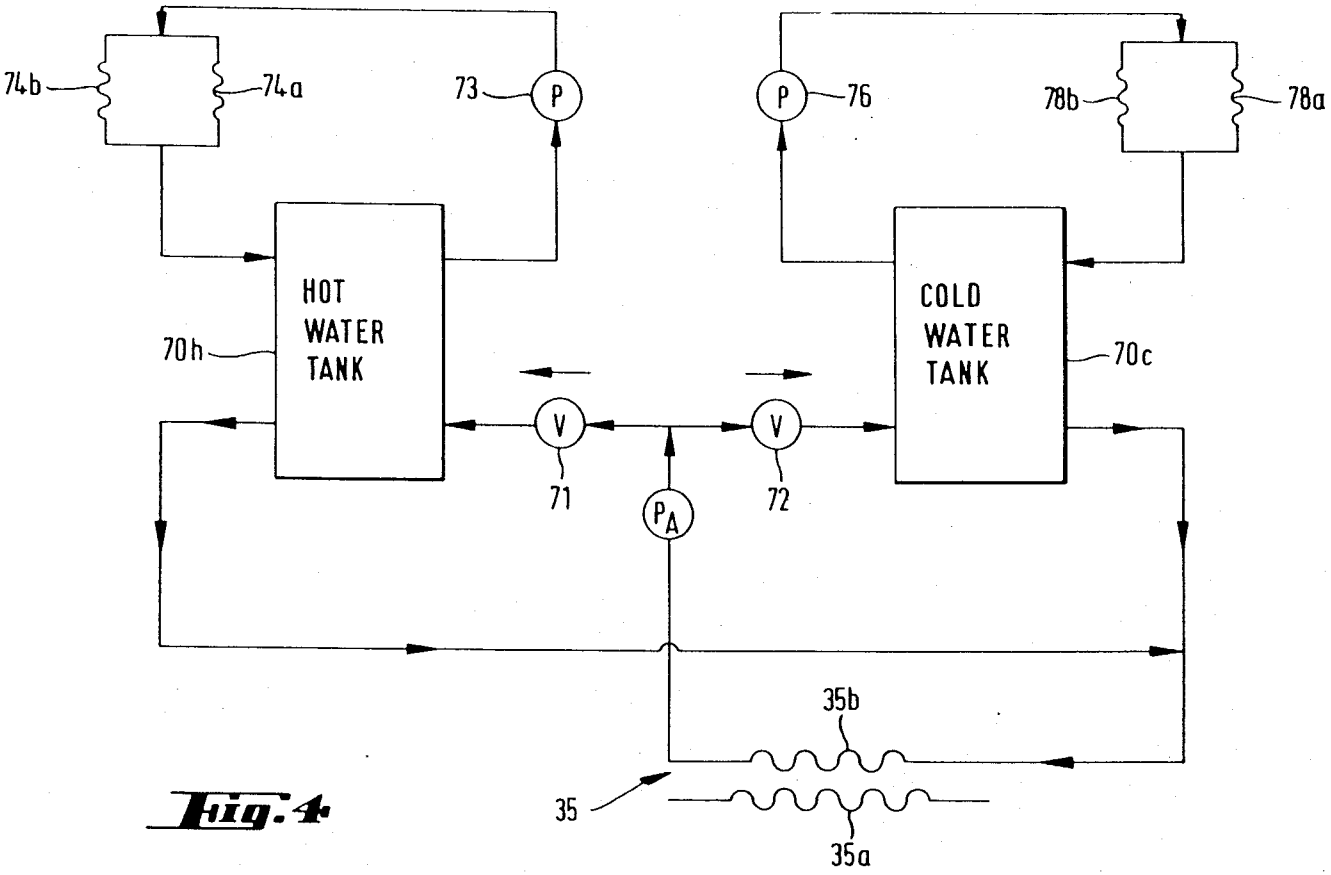
FIG. 4 is a diagram useful in explaining another novel aspect of the invention.

Basically except for primary coil 35*a* and secondary coil 35*b* of heat exchanger 35, all the other parts shown in FIG. 4 are located in user A. It is assumed to include two energy storing units, such as a hot water tank 70*h* and a cold water tank 70*c*. Also included are two unidirectional flow valves 71 and 72. Tank 70*h* is connected through a pump 73 to one or more fan coils, such as the two fan coils 74*a* and 74*b*. The fan coils 74*a* and/or 74*b* are located in one or more parts of user A, e.g. bedrooms which are to be heated. Whenever the temperature in these part(s) is lower than desired as determined by thermostats (not shown) in such part(s), the pump 73 is activated to circulate hot water from tank 70*h* to the fan coils 74*a* and 74*b*.

Similarly, through a pump 76 fan coils 78*a*, 78*b* are connected to the cold water tank 70*c*. Pump 76 is activated to cause cold water from tank 70*c* to circulate through fan coils 78*a*, 78*b* and thus cool a different part or parts of user A, e.g. the living room.

Clearly, to heat one part of the body the temperature of the water in tank 70*h* must be at least somewhat higher than the desired warm temperature. Likewise to cool another part of user A, the water in tank 70*c* must be at least somewhat lower than the desired cooling temperature. The temperatures of the water in tanks 70*h* and 70*c* are controlled by pump $P_A$ and the two valves 71 and 72 as well as heat changer 35 which, via coil 35*b* is connected to pump $P_A$, as shown in FIG. 4. Briefly, with both switches S1 and S2 On the temperature of the water in each of the tanks 70*h* and 70*c* is sensed and signals sent to the control unit 20. If the water temperature in tank 70*h* is below a selected temperature, i.e. the water in tank 70*h* is too cold, pump $P_A$ and valve 71 are turned On, and the system is operated so that exchanger 35 operates as a condenser. In this case valve 72 is closed. Consequently water flows via the loop which includes coil 35*b*, pump $P_A$, valve 71 and tank 70*h*, thus heating the water therein until it reaches the desired temperature. Similarly, if the water in tank 70*c* is above a desired temperature level, valve 72 is opened while valve 71 is closed and the system is switched to operate so that heat exchanger 35 operates as an evaporator. Thus the water flowing through coil 35*b* to tank 70*c* is cooled.

Clearly, one cannot heat the water in tank 70*h* while at the same time cooling the water in tank 70*c*. To this end, control unit 20 may include means to establish an order of priority. For example, one can set the system so that during one half of each time period cooling takes place, while during the other half heating takes place, until the temperature of the water in each tank reaches the desired level. Also different priorities can be established. For example, the system may be controlled to first cool the water in tank 70*c* to the desired temperature and only thereafter heat the water in tank 70*h* or vice versa.

It should be stressed that just as herebefore described, user B may be heated by turning S3 On even when either S1 or S2 is On, i.e. when user A is cooled or heated, if desired switch S3 may be turned On when both switches S1 and S2 are On. That is, when user A is to be heated and cooled. Although user A in terms of the system cannot be cooled and heated simultaneously since the heat exchanger 35 cannot operate as an evaporator and condenser at the same instant, since it can be switched quickly from one mode of operation to the other, user A can be thought of as being substantially heated and cooled simultaneously.

Although particular embodiments of the invention have been described and illustrated herein, it is recognized that modifications and variations may readily occur to those skilled in the art. For example, the valve expansion assembly 40 need not consist of the parts as shown, as long as it can expand refrigerant supplied thereto via line 38 as shown in FIG. 1 or via line 37, as shown in FIG. 2. That is it need function as a reversible expansion device. Among other possible implementations assembly 40 may consist of a capillary tube-type expansion valve.

We claim:

1. A heat transfer system comprising:

first, second and third controllable heat exchangers, each having a primary coil through which refrigerant is adapted to flow with said first and second heat exchangers further including at least a secondary coil in heat transfer contact with said primary coil for providing a separate path for fluid to flow therein and said third exchanger includes operable means for circulating fluid about the primary coil of the third exchanger;

a compressor having an inlet and an outlet for compressing gaseous refrigerant supplied thereto at its inlet and for providing compressed gaseous refrigerant at the outlet thereof;

a two-state flow path reversing valve having first, second, third and fourth ports, said valve providing two separate flow paths between its first and fourth ports and its second and third ports, when being in a first of its two states and further providing two separate flow paths between its first and second ports and its third and fourth ports when being in its second state;

expansion valve means for expanding liquid refrigerant supplied thereto to effectively reduce its pressure;

first means for providing a refrigerant flow path between the third port of the path reversing valve and the compressor's inlet, and between the compressor's outlet and the first port through the primary coil of said first exchanger;

second means for providing refrigerant flow path between said second and fourth ports through the primary coil of said second heat exchanger, said expansion valve means and the primary coil of said third heat exchanger connected thereby in series; and control means including manually controllable switches for controlling said system whereby when said path reversing valve is in said first state either said first and second heat exchangers are operable as a condenser and an evaporator respectively while said third heat exchanger is inoperative or said third and second heat exchangers operate as a condenser and an evaporator respectively while said first heat exchanger is inoperative and when said valve is in its second state said first and second heat exchangers are connected in series with at least one of them being operable as a condenser while said third heat exchanger is operable as an evaporator.

2. A heat transfer system as recited in claim 1 wherein the secondary coil of said second heat exchanger is connectable to fluid pipes extending from a first primary user whereby when said second heat exchanger is operable as a condenser or as an evaporator under the control means, the fluid flowing in the pipes of the first user is heated and cooled, respectively.

3. A heat transfer system as recited in claim 2 wherein the secondary coil of said first heat exchanger is connectable to fluid pipes extending from a second primary user whereby when said first heat exchanger is operated as a condenser under the control of said control means heat is transferred to the fluid flowing in the pipes of the second user.

4. A heat transfer system as recited in claim 3 wherein the fluid in at least the pipes of said second user is water.

5. A system as recited in claim 1 wherein said third heat exchanger includes a fan controllable by said control means for circulating air from outside the system about the primary coil of said third heat exchanger.

6. A system as recited in claim 2 wherein said second heat exchanger includes a third coil connectable to pipes extending from a first secondary user, said first secondary user including temperature sensing means and a circulating pump coupled to said pipes and pump control means for controlling said pump to cause fluid to flow through said pipes and the third coil of said second heat exchanger only when the latter operates as an evaporator and the temperature of said first secondary user as sensed by said temperature sensing means is greater than a preselected temperature.

7. A system as recited in claim 6 wherein said first heat exchanger includes a third coil connectable to pipes extending from a second secondary user, said second secondary user including temperature sensing means and a circulating pump coupled to said pipes and pump control means for controlling said pump to cause fluid to flow through said pipes and the third coil of said first heat exchanger only when the compressor means is operational and the temperature of said second secondary user as sensed by said temperature sensing means is less than a preselected temperature.

* * * * *